US006578584B1

(12) United States Patent
Beven et al.

(10) Patent No.: US 6,578,584 B1
(45) Date of Patent: Jun. 17, 2003

(54) SMOKING ARTICLE WITH NON-COMBUSTIBLE WRAPPER, COMBUSTIBLE FUEL SOURCE AND AEROSOL GENERATOR

(75) Inventors: John Lawson Beven, Thurleston (GB); David John Dittrich, Southampton (GB); Colin Campbell Greig, Redlynch (GB); Richard Geoffrey Hook, Winchester (GB); Kevin Gerard McAdam, Southampton (GB); Rosemary Elizabeth O'Reilly, Eastleigh (GB)

(73) Assignee: British American Tobacco (Investments) Limited, Southampton (GB)

( * ) Notice: Subject to any disclaimer, the term of this patent is extended or adjusted under 35 U.S.C. 154(b) by 0 days.

(21) Appl. No.: 09/577,919

(22) Filed: May 24, 2000

Related U.S. Application Data

(63) Continuation of application No. 08/793,524, filed on Feb. 27, 1997, now Pat. No. 6,095,152.

(30) Foreign Application Priority Data

Sep. 7, 1994 (GB) ..... 9417970
Aug. 2, 1995 (GB) ..... 9515836

(51) Int. Cl.[7] ..... A24D 1/02; D21H 27/00

(52) U.S. Cl. ..... 131/365; 131/360; 162/139

(58) Field of Search ..... 131/194, 365, 131/352, 353, 354, 355, 356, 358, 359, 364, 375, 374, 360; 162/139

(56) References Cited

U.S. PATENT DOCUMENTS 5,303,720 A * 4/1994 Banerjee et al. ..... 131/194
5,660,903 A * 8/1997 Andersen et al. ..... 428/26.4
5,736,180 A * 4/1998 Peiffer et al. ..... 426/138
6,095,152 A * 8/2000 Beven et al. ..... 131/194

* cited by examiner

*Primary Examiner*—Steven P. Griffin
*Assistant Examiner*—Dionne A. Walls
(74) *Attorney, Agent, or Firm*—Pitney, Hardin, Kipp & Szuch LLP

(57) ABSTRACT

The invention relates to a smoking article (1) having a high proportion of non-combustible, inorganic material and a relatively low level of visible sidestream. The smoking article includes a substantially non-combustible, wrapper (5) which extends along the full length of the smoking material rod and enwraps a combustible fuel source (6) and aerosol generator (7), both of which extend substantially along the length of the smoking material rod. Various suitable fuel source systems and aerosol generating systems are described. The article has a visible burn line which advances along the article and produces an ash which can be removed by the smoker in the normal way.

17 Claims, 1 Drawing Sheet

Figure 1:
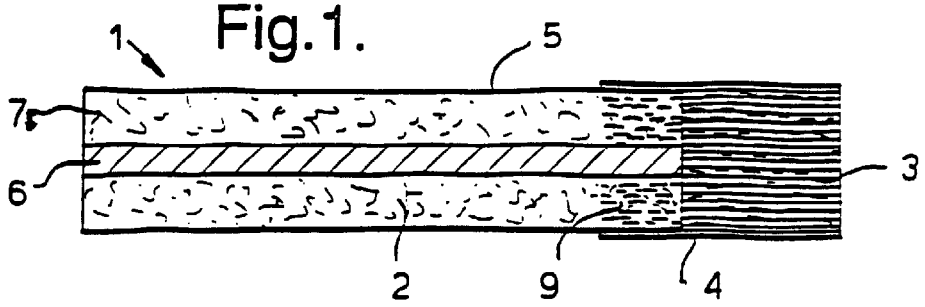

SMOKING ARTICLE WITH NON-COMBUSTIBLE WRAPPER, COMBUSTIBLE FUEL SOURCE AND AEROSOL GENERATOR

This application is a continuation of U.S. Ser. No. 08/793,524 filed Feb. 27, 1997 which issued as U.S. Pat. No. 6,095,152 on Aug. 1, 2000. U.S. Ser. No. 08/793,524 is a national stage application of PCT/GB95/02110 and claims priority under 35 U.S.C. §119 from UK 9417970 filed Sep. 7, 1994 and UK 9515836 filed Aug. 2, 1995.

The present invention relates to smoking articles, and in particular to smoking articles which have an other than conventional structure and combustion regime, yet which have the outward appearance similar to a conventional smoking article.

Many attempts have been made to produce a smoking article which provides the smoker with an aerosol which is similar to tobacco smoke. Some ideas have centred on generating an aerosol vapour from an aerosol generating means by heating the aerosol generating means with a surrounding fuel source, such as cut tobacco. Smoke from the fuel source is prevented by a smoke barrier from reaching the smoker's mouth, whilst the aerosol vapour can pass to the smoker. These can be seen in U.S. Pat. Nos. 3,258,015 (Ellis) and 3,356,094 (Ellis). The first of these proposed a smoking article having an outer cylinder of fuel with good smouldering characteristics, preferably cut tobacco or reconstituted tobacco, surrounding a metal tube containing tobacco, reconstituted tobacco or other source of nicotine and water vapour. A substantial disadvantage of this article was the ultimate protrusion of the metal tube as the tobacco fuel was consumed. Other disadvantages include the formation of substantial tobacco pyrolysis products and substantial tobacco sidestream smoke. This design was later modified in the second patent mentioned above by employing a tube made out of a material such as inorganic salts or an epoxy bonded ceramic, which became frangible on heating and was discharged as an ash by the smoker. In this invention also there are substantial tobacco pyrolysis products and, because of the combustion of tobacco, visible sidestream smoke.

Aerosol inhalation devices such as European Patent Applications, Publication Nos. 0 174 645 and 0 339 690 describe means of using heat transfer from a fuel element to physically separate aerosol generating means. The main feature of these inventions is that the aerosol generating means is always physically separate from the fuel element and is always heated by heat transfer from a heat conducting member, never burned. To this end the fuel element is always short, located to one end of the smoking article and kept out of direct contact with the aerosol generating means.

Other and mainly more recent devices have included GB 1 185 887 (Synectics), U.S. Pat. No. 5,060,667 (Strubel) and EPA 0 405 190 (R. J. Reynolds). In all of these devices the patentee has arranged the fuel element as an annulus around aerosol generating means.

GB 1 185 857 provided a substantially inorganic smoke of readily absorbable salts to the smoker and produced an ash which could be removed in normal fashion by the smoker. However, the smoking article is presumed to have given off an amount of visible sidestream smoke because of the cellulosic components within individual items of the smoking article.

U.S. Pat. No. 5,060,667 provided a co-axially arranged tobacco-containing fuel element encircled by a metallic heat transfer tube with a flange portion at the end to be lit in order to prevent smoke from the burning tobacco from passing through the flavour source material circumscribing the heat transfer tube. Only aerosol from the flavour source material passes to the smoker. The device does not burn down and tobacco material is combusted, as well as providing the flavour source material, thereby producing visible sidestream smoke and utilising a high percentage of a costly item such as tobacco.

EPA 0 405 190 seeks to provide a smoking article which provides the user with the pleasures of smoking by heating without burning tobacco. Most of the articles comprise an annular carbonaceous fuel segment, a physically separate aerosol generating means disposed concentrically within the fuel segment, a barrier member between the fuel segment and the aerosol generating means, which substantially precludes fluid flow radially therethrough and which is disposable as the smoking article is smoked, and a mouthend segment. As the fuel source is disposed annularly around the aerosol generating means it is advantageous to surround the fuel source longitudinally with an insulating sleeve which may then be wrapped with a conventional wrapper. One alternative embodiment is postulated which comprises a co-axial carbonaceous fuel source of slow burning rate encircled along its longitudinal length by an insulation member, which in turn is encircled along its length by tobacco wrapped in a paper wrapper. The tobacco is only heated and not burnt, as in the other embodiments, but unlike the other embodiments of EPA 0 405 190 the device cannot burn down as tobacco would then be burnt. No actual practical embodiment is described and thus this embodiment appears to be an armchair, or paper, proposal. The patentees appear to have had some difficulty in reducing to practice this particular concept. This concept also utilises considerable amounts of expensive tobacco, to provide the aerosol source material, which the smoker never truly experiences.

U.S. Pat. No. 2,998,012 discloses a smoking article having a non-combustible wrapper of woven, glass fibres with one or more adhesive materials, calcium carbonate to prevent flaming, propylene glycol as a plasticiser and a diatomaceous earth to render the wrapper impermeable and cooler to the touch. A disadvantage of this construction is that the wrapper still maintains a predominantly fibrous characteristic of woven glass fibres. Such a wrapper would be unacceptable for a commercial smoking article. U.S. Pat. No. 4,961,438 discloses a smoking device which does not burn down along its length which by means of a smouldering heat source heating air drawn into the device liberates aerosol from an aerosol forming material disposed on a substrate. The wrapper of the device is a non-combustible tube having high heat conductivity. Such high heat conductivity is undesirable for a commercial smoking article. The wrapper of the present invention seeks to overcome these deficiencies.

It is an object of the present invention to provide a smoking article which does not produce substantial tobacco pyrolysis products.

It is a further object of the present invention to provide a smoking article which exhibits very little visible sidestream smoke, and considerably less visible sidestream smoke than prior proposed conventional smoking articles comprising tobacco rods of cut tobacco wrapped in a paper wrapper containing a visible sidestream reducing compound or being a visible sidestream reducing paper.

It is another object of the invention to fulfil the above objectives whilst maintaining a substantially conventional outward appearance of a smoking article as we know the same today.

It is also an object of the invention to preserve the physical elements of the smoking process, including the ashing of a cigarette to produce an ash which can be removed by the smoker in the normal way.

The present invention provides a smoking article having a smoking material rod comprising a substantially non-combustible wrapper extending substantially along the length of the smoking material rod and enwrapping a combustible fuel source extending substantially along the length of the smoking material rod and aerosol generating means extending substantially along the length of the smoking material rod.

As used herein the terms 'smoking material rod' or 'smoking material' are merely intended to mean that part of the smoking article which is contained within the substantially non-combustible wrapper and should not have imported therein any association as to the combustibility or otherwise of individual components of the rod of the smoking material.

The present invention further provides a smoking article having a smoking material rod comprising a substantially non-combustible wrapper extending substantially along the length of the smoking material rod and enwrapping a combustible fuel source extending substantially along the full length of the smoking material rod, and aerosol generating means being disposed between the fuel source and the wrapper and extending substantially along the length of the smoking material rod.

The present invention provides a substantially non-combustible smoking article wrapper comprised of predominantly non-combustible inorganic filler material, a binder, optionally a plasticiser, and optionally a small amount of cellulosic fibre material.

Preferably the non-combustible inorganic filler material is a particulate material and even more preferably is a non-metallic material.

This invention also provides a method of producing a substantially non-combustible smoking article wrapper comprising predominantly non-combustible inorganic filler material and a binder, the method comprising producing a mixture of the non-combustible inorganic filler material and a binder, extruding the mixture to provide a hollow tube, and contacting the hollow tube with a material which causes the hollow tube to set rapidly.

The material which causes the hollow tube to set rapidly may be a water scavenging substance which removes water contained in the extrudate. Alternatively the material may be a solution which renders a soluble binder in the mixture insoluble, or a hydrophilic substance which removes water from an aqueous-containing mixture.

The present invention also provides a smoking article fuel source of substantially the whole length of a smoking article, the fuel source comprising carbonaceous material, an inorganic non-combustible binder and optionally a burn promoter.

The present invention provides a smoking article fuel source of substantially the whole length of a smoking article, the fuel source comprising carbon, non-combustible inorganic filler material, organic binder, optionally plasticiser and optionally inorganic binder.

The present invention provides smoking article aerosol generating means comprising a non-combustible inorganic filler material, aerosol forming means, and an organic or inorganic binder.

The present invention also provides a smoking article aerosol generating means comprising an organic filler material, aerosol forming means, an organic binder and optionally a non-combustible inorganic filler material.

The present invention provides a smoking article aerosol generating fuel source comprising a non-combustible inorganic filler material, aerosol forming means, an organic or inorganic binder and carbon.

The present invention further provides a smoking article aerosol generating fuel source comprising organic filler material, optionally a non-combustible inorganic filler material, aerosol forming means, organic binder and carbon.

Substantially non-combustible Wrapper

Preferably the substantially non-combustible wrapper is comprised of predominantly non-combustible inorganic filler material. The term 'predominantly' as used herein means at least about 65% and usually 70%. The inorganic filler material advantageously yields very little or substantially no visible sidestream smoke when the smoking article is lit. Preferably the non-combustible wrapper comprises at least 80%, and more preferably at least 90% inorganic filler material by weight of the wrapper. Advantageously the non-combustible inorganic filler material is one or more of perlite, vermiculite, diatomaceous earth, colloidal silica, chalk, magnesium oxide, magnesium sulphate, magnesium carbonate or other low density, non-combustible inorganic filler materials known to those skilled in the art.

The non-combustible wrapper may comprise a small amount of cellulosic fibre material. Preferably the fibre material comprises less than 10%, more preferably less than 5%, and even more preferably less than 2% by weight of the non-combustible wrapper. Most advantageously the fibre material is not present in the wrapper.

Preferably the wrapper comprises a binder and/or a plasticiser. These components may be present at up to 30% by weight of the wrapper. Advantageously the binder is not present at more than 25% by weight of the wrapper. The exact proportions will depend on the taste characteristics, acceptable visible sidestream smoke emission and strength of the desired product, and the processing techniques used. The binder may be present at about 8–10% by weight of the wrapper, although it may be present at about 5% or less by weight of the wrapper. The binder may be organic binders, for example, cellulose derivatives, such as sodium carboxymethylcellulose, methyl cellulose, hydroxypropylcellulose, hydroxyethyl cellulose or cellulose ethers, alginic binders including soluble alginates such as ammonium alginate, sodium alginate, sodium calcium alginate, calcium ammonium alginate, potassium alginate, magnesium alginate, triethanol-amine alginate and propylene glycol alginate or insoluble alginates which can be rendered soluble by the addition of solubilising agents, such as ammonium hydroxide. Examples of these include aluminium, copper, zinc and silver alginates. Alginates which are initially soluble but which, during processing, undergo treatment to render them insoluble in the final product may also be used, e.g. sodium alginate going to calcium alginate (see below). Other organic binders include gums such as gum arabic, gum ghatti, gum tragacanth, Karaya, locust bean, acacia, guar, quince seed or xanthan gum, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Combinations of the above may also be used. Inorganic non-combustible binders, such as potassium silicate, magnesium oxide in combination with potassium silicate, or some cements, for example, and mixtures thereof, may be used.

The wrapper, although not giving much, if any, visible sidestream smoke, does produce ash of an acceptable colour and quality. The smoking article also has a visible burn line which advances along the article and enables the smoker to determine whether the article is alight and to monitor the smoking process. The visible burn line may be formed as a result of burning the organic binder. Alternatively, colour changing compounds can be included in the wrapper composition. Colourants which give the wrapper an other than white colour may also be included. These colourants may also change colour as heating occurs, providing a visible burn line, e.g. $CuSO4.5H_2O$.

The nature of the binder selected will also determine the permeability of the outer wrapper. Binders, such as sodium carboxymethylcellulose and propylene glycol alginate, have been found to be particularly effective at producing an outer wrapper sufficiently permeable to sustain combustion of the fuel source within the wrapper. The latter binder gave the more permeable outer for the same outer wrapper composition. Hydration time of some binders can play a part in determining the efficacy of the binders. Conventionally understood strong binders such as hydroxypropylcellulose can be used at lower levels to increase the wrapper permeability but this has to be balanced against the strength of the wrapper.

The plasticiser may be present in the wrapper at up to 20% by weight thereof. The plasticiser is preferably present at about 10% or less, preferably 5% or less, by weight of the wrapper. The plasticiser may be glycerol, propylene glycol, or low melting point fats or oils for example. Depending on the method of production selected for the wrappers, the plastisicer may be absent from the wrapper composition. The plasticiser helps in the drying stages of the wrapper to prevent shape distortion, particularly if direct heat, e.g. hot air, is the drying medium. The amount of plasticiser, binder or other organic filler material will affect the appearance of the burn line, i.e. the burn line width, and the amount of visible sidestream of the article. Preferably the width of the burn line is not greater than 10 mm, is preferably not more than 5 mm and more preferably is between 2–3 mm in width. The width of the burn line depends on the composition of the burnable material in the article.

The wrapper may comprise materials which provide an odour to any sidestream smoke which may come from the article. Suitable deodorisers include citronellal, vanillin and geraniol, for example.

The wrapper may be formed by producing a thick slurry of the wrapper components, coating the slurry about a rotating mandrel, and removing excess moisture by physical or chemical means. Alternatively, the slurry may be cast as a sheet on a drum or band caster, or extruded as a hollow tube, through a 'torpedo' die-head, for example, which has a solid central section, or extruded as a sheet material. The slurry could be sprayed, coated or pumped onto a suitably shaped fuel/aerosol assembly.

The extrusion process is suitably carried out at a pressure which does not detrimentally affect the wrapper permeability and is suitably not greater than 3–4 bar (300–400 kPa) at the extruder die of a ram extruder, for example, and not more than 9 bar (900 kPa) for an APV Baker Perkins screw extruder. The extrusion process may require foaming to occur at the die exit to produce a cellular structure, in which case greater pressure can be exerted, at the die, whilst retaining permeability.

After extrusion or coating the hollow extrudate or coated mandrel is suitably subjected to heat at or exit the die to drive off excess moisture. The wrapper slurry may comprise a heat activated binder, such as potassium silicate, magnesium oxide, or hydroxypropylcellulose at temperatures above 40–50° C., for example. Subjecting the coated mandrel or hollow extrudate to heat would activate the binder causing the wrapper to set. Infra-red or microwave heating is advantageous as direct heating, e.g. the use of hot air blowers, can affect the shape of the extrudate, especially at temperatures of greater than 100° C.

Extrusion may be carried out using a single or double screw extruder, a ram extruder or slurry pump.

The wrapper suitably has a thickness within the range of 0.1–1.0 mm, although 2–3 mm may be desirable. The thickness required depends on the weight and permeability of the wrapper. Thus, a dense thin wrapper or a thick low density wrapper could be provided, depending on the composition of the wrapper materials.

Alternative setting methods for the wrapper include the use of water scavenging substances. These substances remove water from the wrapper slurry thereby, in effect, drying the wrapper. For example, light magnesium oxide can be in the wrapper slurry mixture at up to 45% by weight of the dry slurry constituents, depending on the residence time in the extruder and the temperature in the extruder. The addition of magnesium oxide can also have advantageous visible sidestream reducing effects. Alternatively, the wrapper material can be extruded into an ethanol bath, or other strongly hydrophilic substance, the ethanol scavenging the water from the extrudate. A further alternative is the precipitation of an insoluble alginate from a soluble alginate in the extruded wrapper. This can be achieved by, for example, extruding a hollow tube of, for example, sodium alginate-containing wrapper material into a bath of simple electrolyte (s), for example, 1.0M calcium chloride solution. The calcium ions substitute for the sodium ions and cause the extrudate to set extremely quickly. In the latter two methods, spraying of the water scavenger onto the extrudate or wrapper sheet may be carried out instead of passing the extrudate into a bath.

Some precipitation can be achieved by adding a subcritical level of a precipitating agent into the extruder barrel, then completely precipitating the structure by raising the level of the precipitating agent post extrusion. Other precipitation methods include precipitation of the extrudate into a highly ionic electrolyte bath or into a water miscible non-solvent for the alginate.

A further method includes, as briefly mentioned above with respect to the binders, use of a conventionally insoluble alginate as the binding material by rendering it soluble with a solubilising agent and then setting of the wrapper structure by removal of the solubilising agent or addition of a sequestering agent.

These methods may be used sequentially, e.g. the wrapper may be set by precipitating a soluble alginate containing wrapper material in a bath containing calcium ions. The extrudate may be subsequently passed into a bath of water scavenging agent, such as ethanol, and then heated to drive off liquid residues. Alternatively, after setting the wrapper may be dried using the methods described above.

These methods are particularly effective for achieving a good shape to the extrudate because of the speed of the reaction and the lack of volume reduction in the processes, particularly the drying stages.

The wrapper may have a rigid structure, although we have found that flexible wrappers can be produced using sodium alginate as the binder, which is then precipitated to form calcium alginate and then slowly dried. Flexibility is advantageous in terms of the increased robustness of the product during machine and manual handling.

The wrapper suitably has a air permeability within the range of 1–300 Coresta Units (cc/min/1 $cm^2$/10 cm WG).

Permeability can be controlled by a number of methods, such as coating an extrudate with a film forming or other permeability reducing agent. Alternatively, sacrificial molecules can be introduced into the wrapper mixture, which molecules can be removed after the formation of the structure by moderate temperature or chemical reaction to increase the permeability of the wrapper structure.

Alternatively, the wrapper may be a cellulose-based wrapper, such as conventional cigarette paper, which has been treated to prevent the wrapper from burning and thereby producing visible sidestream smoke. Preferably the treated wrapper will char and therefore provide a visible burn line. The paper should also produce an ash which can be knocked off by the smoker.

The ashing characteristics of the wrapper should be such that, unburnt, the wrapper is strong enough or flexible enough to resist digital pressure prior to, and during smoking, but upon thermal degradation of the wrapper the structure is considerably weakened, leaving an ash which can be readily disintegrated by pressure or a flicking movement. Some wrappers may require ash charring agents which char to leave some black residue to simulate conventional cigarette ash.

Fuel Source

Preferably the fuel source extends continuously from the mouth end of the smoking article to the lighting end thereof, excluding any filter or mouthpiece element. In the alternative, the fuel source may comprise a number of sections closely located so that burning of the fuel source does not cease.

Advantageously, the end of the article to be lit has the appearance of a conventional article. Suitably the end of the smoking article at the end to be lit is of a tobacco-like or dark colour, e.g. brown.

The fuel source may be provided by three distinct systems, but overlap may occur between them. In these systems the fuel source is physically discrete from the aerosol generating means.

When physically discrete from the aerosol generating means and in the form of a rod, in a first system the fuel source is suitably prepared from carbonaceous material by pyrolysing wood, such as rods of balsa wood, cotton, rayon, tobacco or other cellulosic containing material, which are prepared to a shape which is particularly useful in the present invention. In this system, the fuel source comprises at least 85% by weight pyrolysed carbonaceous material. Preferably the fuel source comprises at least 90% carbonaceous material. A burn promoter such as, for example, potassium nitrate, potassium citrate or potassium chlorate, is also advantageously present at 10% or less by weight of the fuel source. Other suitable burn promoters would be known to those skilled in the art. Alternatives for an almost wholly carbon-containing system include the use of carbon fibres or carbon aerogels.

The term 'carbon' as used herein can be taken to cover a material which is substantially solely carbon and any carbon precursors, such as carbonaceous material. As used herein the term carbonaceous includes material which has been pyrolysed, which material preferably contains carbon, although some incomplete combustion products may still be present. Ready pyrolysed coconut fibre may, for example, be the carbonaceous material from which carbon is derived.

In a second system, the fuel source may be a substantially inorganic system and comprise an inorganic, non-combustible binder, selected from the list outlined above with respect to the wrapper, for example, Portland cement, or potassium silicate. The binder may be present within the range of 10–65% by weight of the fuel source. The binder is advantageously present in an amount of less than 40% by weight of the fuel source. The fuel source may also comprise 5–20% of a burn promoter, preferably less than 10%, by weight of the fuel source. The fuel source may comprise 25–70% carbon, advantageously at least 55% carbon, and more suitably at least 60% carbon by weight of the fuel source. However, we have found that acceptable combustion characteristics can still be maintained with about 30% carbon, 60% inorganic, non-combustible binder and less than about 10% burn promoter when the fuel source is provided as a rod. A proportion of inorganic, non-combustible filler in the rang of 0–60% may also be incorporated in this alternative to reduce the density of the fuel source or to improve the strength of the fuel source.

The fuel source in this instance may, for example, be a shaped rod of carbon having a porous structure to sustain continuous combustion throughout the length of the fuel source. Shaping techniques which do not disadvantageously lose water during shaping of the rod are preferred. Shaping of a thick slurry comprising carbon and a binder within a hollow tube and removing the shaped rod from the tube after a curing or setting stage is one method of fuel source production. Alternatively, an extrusion process may be used.

In the third system, the fuel source is a partially organic system and comprises 15–70% carbon, 84–5% non-combustible inorganic filler material such as, for example, one or more of the inorganic filler materials listed above with respect to the wrapper, 0–5% plasticiser, such as one or more of low melting point fats or low melting point oils, and 1–20% organic binder, such as cellulosic, alginic or pectinaceous binders, for example, and/or the other organic binders described above with respect to the wrapper. A mixture of inorganic or organic binders may be used, the inorganic binder being present within the range of 0–20% by weight of the fuel source. The plasticiser is included to improve the mechanical strength and flexibility of the fuel source and the amount present together with the amount of organic binder, should not provide a significant quantity of mainstream smoke. A high level of organic binder might be utilisable if the binder produces a low level of mainstream smoke, i.e. particulate matter. The amount of carbon is subject to the type and amount of binder and/or filler utilised, thus the range above should not be considered too limiting. The amount of carbon required will also depend on the composition of the outer wrapper. Furthermore, at low levels of carbon usage the outer wrapper will need to be more permeable than at higher carbon levels. Most suitably the carbon is present in the range of 25–35%.

Extrusion may be a low pressure extrusion through a nozzle using a driving force not substantially greater than atmospheric pressure, or a high pressure extrusion process. Foaming of the extrudate to achieve a cellular structure may be required, particularly in the second and third systems, depending on final product design. In the second system, foaming could be achieved by the introduction of air entraining agents instead of a proportion of the inorganic, non-combustible binder and/or the inorganic filler, if present. The air-entraining agents can be powdered or liquid additives or porous particulate materials. In the third system when foaming is required it may be achieved by the presence of, for example, a polysaccharide expansion medium such as starch, and the expanding effect of water under high temperature and pressure. The expansion medium would replace the binder or the plasticiser or inorganic filler, if present. Alternative expansion mediums, such as pullulan or other polysaccharides, including cellulose derivatives, may be used. Other agents capable of causing foaming may be solid foaming agents, such as sodium bicarbonate, inorganic salts and organic acids providing in situ gaseous agents; propane or isobutane as organic gaseous agents; nitrogen, carbon dioxide or air as inorganic gaseous agents; and volatile liquid foaming agents, such as ethanol and acetone, for example. Polysaccharide expansion mediums are preferred because of their ease of usage and safety aspects.

Extrusion may produce thin elongate strands, which may be longitudinally arranged, or more solid thicker rods, preferably co-axially located within the smoking material rod. In the first two alternatives, i.e. the pyrolysed structure and the inorganic system, a central rod could be replaced by several thinner strands. Extruded sheet may also be produced, then shredded to produce cut filler similar to cut tobacco filler. These processes are all suitable for the production of the fuel source, the aerosol generating means and the combined aerosol generating fuel source to be described later. Band casting, heated drum casting and other sheet making techniques can also be used.

In all of the above fuel source alternatives, except in the pyrolysed rod embodiment, 0–2% fibre is optional. This also applies to those methods of preparation of aerosol generating means which involve casting or paper making techniques.

Aerosol generating means

The aerosol generating means may be provided by three distinct systems, but overlap may occur between them.

The first system may be a substantially inorganic system comprising 95–30% inorganic, non-combustible binder, such as those binders described above with respect to the fuel source, 0–65% non-combustible inorganic filler material, such as those materials described above with respect to the fuel source, and 5–30% aerosol forming means, as described below.

The second system may be a partially inorganic system comprising 1–25% organic binder, 45–94% non-combustible inorganic filler material and 5–30% aerosol forming means. The third system may be a partially organic system comprising 1–25% organic binder, 1–94% organic filler material, 0–93% inorganic filler material and 5–30% aerosol forming means. Preferably the aerosol forming means comprises 5–25% by weight of the mixture. These systems are intended to be substantially non-combustible. The inorganic filler material is therefore selected, in combination with the proportions of the other materials, to provide substantially non-combustible aerosol generating means. Some inorganic fillers, such as perlite, magnesium hydroxide and magnesium oxide, readily serve to render the aerosol generating means non-combustible. Other fillers, such as chalk, at some incorporation levels, do not detract from the combustibility of the aerosol generating means and as such are unsuitable at those levels.

The organic filler material is preferably a material other than tobacco and may include inorganic salts of organic acids, or polysaccharide material, and should provide smoke with an acceptable taste characteristic.

These two systems represent two ends of a spectrum in which inorganic and organic components of the binder and filler material can be gradually substituted for one another. The third system may also incorporate an amount of expansion medium, such as described above, as part of the organic filler material. An example of foamed aerosol generating means comprises 20% organic binder, 20% aerosol forming means, 15% starch as an expansion medium and 45% inorganic filler material. The aerosol generating means may also comprise flavouring means.

A small amount of fibre material may also be required in the above systems to assist in the formation of a sheet, depending on the manner of manufacture.

The aerosol generating means preferably comprises aerosol forming means, such as polyhydric alcohols, glycerol, propylene glycol and triethylene glycol, for example, or esters such as triethyl citrate or triacetin, or high boiling point hydrocarbons.

Flavouring agents in the smoking material rod are designed to contribute towards an aerosol which has a unique but very acceptable taste and flavour characteristic to the aerosol smoke. The taste and flavour may not necessarily be designed to imitate tobacco smoke taste and flavour. Flavouring agents may include tobacco extract flavours, menthol, vanillin, toffee, chocolate or cocoa flavours, for example. Colouring means, such as food grade dyes, for example, or colourants such as liquorice, caramel or malt, or extracts thereof, may be used to darken the colour of the filler material. The presence of vermiculite or other inorganic material, such as iron oxide, may also give a darker colour to the filler material of the smoking article.

Flavouring agents may also be incorporated on or into a substrate, which may be the aerosol generating means and/or the fuel source, at a location close to or at the mouth end of the smoking material rod of the smoking article, or along the length of the smoking material rod provided that they are not affected by combustion temperatures. The percentages given above are given without the addition of any flavouring agent. These percentages will be consequently reduced by the addition of flavouring agents. Where inorganic or organic filler material is present in the aerosol generating means or fuel source, the percentages of these elements would be decreased as flavourants increased. Where filler material is not present, either the carbon or aerosol forming means would be consequently reduced as the flavourants increased.

As mentioned above, the aerosol generating means may be formed by conventional paper-making techniques or by extrusion techniques. The sheet material may be cut or rolled. The inorganic filler materials of these systems can be used in the system mixtures without pre-treatment stages before providing a complete aerosol generating mixture.

Aerosol generating fuel source

As described above both of the fuel source and the aerosol generating means are kept substantially separate from one another, each forming a distinct area of either fuel source or aerosol generating means. In some instances though it may be advantageous to combine the two elements. This can be done by mixing physically discrete fuel source and aerosol generating material or by producing a totally combined aerosol generating fuel source. In the first case, a preferred embodiment is mixing the fuel source as cut filler material with aerosol generating means as cut filler material. Thus, an aerosol generating fuel source comprising a mixture of physically discrete individual cut filler material is provided, which filler material extends the full length of the smoking material rod. This embodiment is particularly advantageous in that it can be made in a manner very similar to conventional cigarette making procedures by providing a mixture of cut filler material to a cigarette making machine. In the second case, carbon is added to the aerosol generating means composition.

The aerosol generating fuel source may be provided by three distinct systems, but overlap may occur between them. The first system is a predominantly inorganic system comprising 0–35% inorganic filler material, 5–30% aerosol forming means, 30–60% inorganic binder, 30–65% carbon and 0–10% burn promoter. The aerosol forming means is selected from the group outlined above with respect to the aerosol generating means. The other components are also to be selected from the respective groups outlined above with respect to the other elements of the invention. This also applies to the systems described below.

The second system is a partially inorganic system comprising 86–0% inorganic filler material, 5–30% aerosol forming means, 1–25% organic binder and 8–60% carbon.

The third system is a more organic system comprising 93–0% organic filler material, 0–93% inorganic filler material, 5–30% aerosol forming means, 1–25% organic binder and 1–60% carbon. The more organic system may be foamed by the presence of an expansion medium and/or expansion agent, at the levels described above.

Preferably the aerosol forming means comprises 5–25% by weight of the mixture.

The binders and aerosol forming means for the above aerosol generating fuel sources may be any one or more of the binders or aerosol forming means exemplified above.

With the increase in organic components and the respective increase in sidestream, the permeability of the outer wrapper must be controlled to reduce the visible sidestream given off by this fuel source composition or, as described below, sidestream reducing agents can be added to the wrapper to reduce the amount of particulate matter forming the sidestream smoke. The thickness of the outer wrapper can also be varied to reduce visible sidestream smoke.

Structure of Article

The smoking article may be provided in a number of physical structures. In all three fuel source systems the fuel source may be provided as a longitudinally extending rod, strands or filaments, advantageously located co-axially of the smoking article. The rods, strands or filaments can be of various shapes, e.g. round, square, star or polygonal, all of which may be hollow or solid, and may be co-axially clustered. In the second and third system the fuel source may also be a sheet material which can be cut to produce shreds. Material of the third system may also be rolled to the desired shape.

When the fuel source is provided as a central rod of either carbonised wood or an extruded rod of the second or third fuel systems, i.e. a cement/carbon fuel source or the partially organic fuel system, the aerosol generating means may be an annulus of cut aerosol generating material or a roll of such material, rolled to provide a sufficient annular density to support the fuel rod, while still allowing air to be drawn through the article by the smoker.

A preferred option is to provide the rod filler material as a cut filler material. In one case, there may be provided a central core of cut fuel material surrounded by an annulus of cut aerosol generating material. This arrangement can also be provided with the aerosol generating means as the core material and the fuel source as the annulus material. Known techniques for producing co-axial structures for cut filler material can be used, e.g. providing a small dimension first wrapped rod which is fed to a further garniture and cut filler material is arranged around the first rod.

In the alternative, if an aerosol generating fuel source is provided, discrete cut aerosol generating means may be intimately mixed with discrete cut fuel source material.

The overall percentages of mixed cut fuel source material and cut aerosol generating material preferably falls within the range of 30–35% carbon, 5–10% binder, 0–2% fibre, 5–10% plasticiser and 40–60% inorganic material. This range may be comprised of the individual sheets of material having the following compositions:

Fuel source: 60–70% carbon, 7% propylene glycol alginate binder, 1% fibre and 32–22% perlite inorganic material.

Aerosol generating means: 7% propylene glycol alginate binder, 1% fibre, 15% glycerol plasticiser and 77% perlite inorganic material.

These materials would typically be mixed in the ratio of 1:1. Other ratios of mixing could be used to give the desired overall range of components described above.

If the aerosol generating means and fuel source are actually combined together chemically, the sheet material may be cut and provided within the outer wrapper as cut filler material. It may be desirable to increase the proportion of fuel material in a further combined sheet material, and to provide this material as a central region of higher carbon density surrounded by a less carbon-containing combined cut sheet material.

When the fuel and aerosol components are produced by extrusion methods, they may be provided as rods, strands or filaments. A coaxial core of several strands (or rods or filaments) may be provided of fuel material surrounded by an annulus of gathered strands of aerosol generating means. The vice versa arrangement is also possible as above. A further arrangement is the intimate inter-mixing of strands of discrete fuel source and aerosol generating means within the outer wrapper. The rods, strands of filaments may also be comprised of the chemically combined aerosol generating fuel source material. These extruded rods, strands or filaments may all be somewhat foamed, if desired.

Where foaming to provide a cellular structure is desired, a core of foamed fuel source may be surrounded by an annulus of foamed aerosol generating means. This may be produced by co-extrusion techniques using cross-head dies, for example. The vice versa arrangement is also possible. It is also possible in all of the above structural embodiments that only one of the core or annulus material is foamed.

Smoking article

Advantageously the smoking article incorporates a filter element which may be conventional fibrous cellulose acetate, polypropylene or polyethylene material or gathered paper material. Multiple filter elements may also be utilised. Filter elements having particular pressure drop characteristics, such as the filter sold by Filtrona and known as The Ratio Filter, may also be utilised. Disposed upon or within the material of the filter element may be further flavouring materials, as described above, which are released or eluted from the filter element by the aerosol generated by the heated or burnt aerosol generation means.

Disposed about the fuel source at the mounted thereof and/or between the fuel source and the filter element may be a firebreak. The firebreak may suitably comprise a more densely packed region of the material comprising the aerosol generating means. Preferably the firebreak also comprises aerosol forming means to enhance the delivery of aerosol to the smoker, as well as protecting the smoker from potentially over-hot smoke as the length of the smoking article decreases. Alternatively, the firebreak may comprise a band of burn retarding material on the exterior of the wrapper, for example. The firebreak may be substantially combustible or substantially non-combustible material.

The proportions of the non-inorganic materials are selected to give a smoking article which exhibits extremely low visible sidestream smoke. A conventional smoking article comprises cut tobacco wrapped in a paper wrapper. A smoking article which exhibits low visible sidestream smoke is required to give a reduction of at least 30% in rate of sidestream particulate matter, known as NFDPM (nicotine free, dry particulate matter) emission, in order for there to be a reduction in visible sidestream which is visible to the naked eye. European Patent Application, Publication No. 0

404 580 describes a smoking article having a paper wrapper which is extremely effective in reducing visible sidestream smoke. Reductions in visible sidestream particulate matter of up to 60% against control cigarettes without the inventive papers are achievable with smoking articles incorporating the paper according to that application. When smoking articles according to the present invention and cigarettes according to EPA 0 404 580 are smoked head to head, smoking articles according to the present invention have even less visible sidestream than the cigarettes of EPA 0 404 580. Smoking articles of the present invention are thus effective to provide visible sidestream reductions far greater than any other smoking article available at the present time.

Smoking articles according to the present invention preferably comprise at least 50% by weight of the article as inorganic material.

Figure 1A:
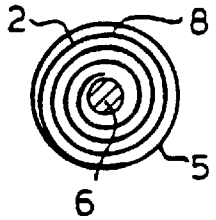
Figure 2:
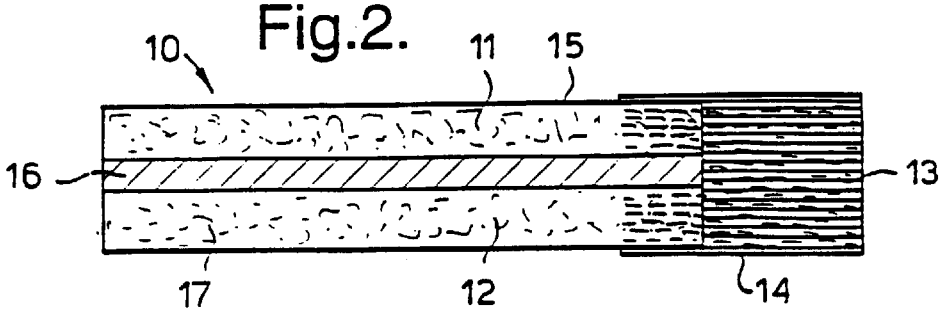
Figure 3:
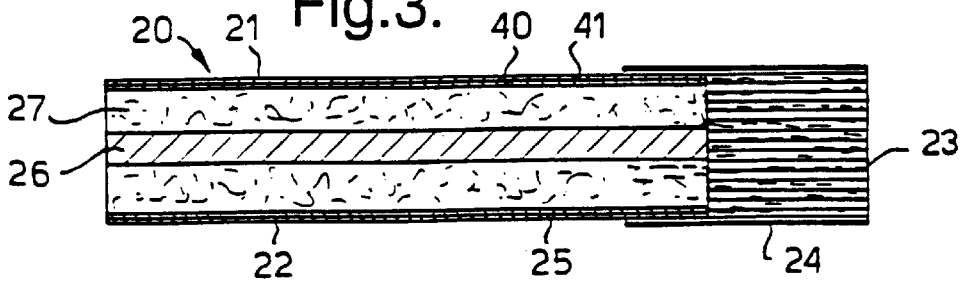
Figure 4:
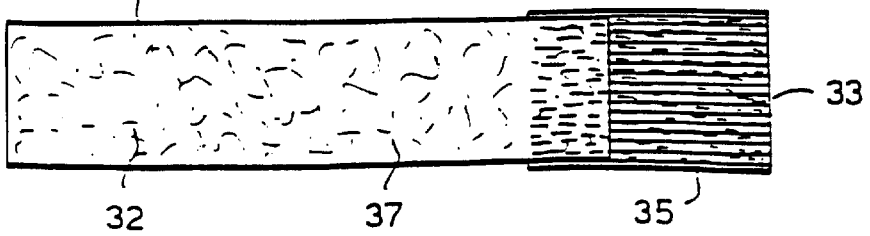

In order that the present invention may be easily understood and readily carried into effect, reference will now be made, by way of example to the following diagrammatic drawings, in which:

FIG. 1 shows, in longitudinal cross-section, a smoking article according to the present invention, FIG. 1*a* shows, in axial cross-section, another embodiment of a smoking article according to FIG. 1, FIG. 2 shows, in longitudinal cross-section, a further smoking article according to the present invention, FIG. 3 shows, in longitudinal cross-section a yet further embodiment according to the present invention, and FIG. 4 shows another embodiment of the present invention in longitudinal cross-section.

One embodiment of a smoking article of the present invention is depicted in FIG. 1 of the drawings hereof. FIG. 1 shows a cigarette 1 comprising a smoking material rod 2 and a filter element 3. The filter element 3 is composed of conventional fibrous cellulose acetate tow but may be of any other type of fibrous material with conventional pressure drop and filtration efficiency, or a high pressure drop, low filtration efficiency, non-fibrous material, if appropriate. The filter element 3 is attached to the smoking material rod 2 by a tipping wrapper 4. The filter element 3 may be ventilated, either using ventilation perforations produced by laser for example, or by means of the natural permeability of the tipping wrapper 4 and any underlying plugwrap. The smoking material rod 2 comprises an exterior wrapper 5, a co-axially located combustible fuel source 6 and cut smoking material 7 disposed between the fuel source 6 and the wrapper 5.

The exterior wrapper 5 comprises 1% fibre, 4% propylene glycol alginate as a combustible binder, 5% glycerol as a plastisicer and 90% perlite as an inorganic non-combustible filler material. The exterior wrapper 5 has a white colour, is about 1 mm in thickness, and looks very similar to the paper wrapper of a conventional smoking article, or cigarette.

The co-axial fuel source 6 was produced in accordance with the first fuel system above by pyrolysing a circular rod of balsa wood having a diameter of about 4 mm. The shape of the balsa wood rod is ideal for the purpose of providing an elongate, circular fuel source. The pyrolysed rod has an acceptable strength and is quite robust when surrounded by the cut smoking material 7. The density of the initial rod, and also in its final form, is important. We have found that if the fuel source is too dense after pyrolysation insufficient oxygen reaches the interior thereof and therefore the fuel source will not continue to burn. On the other hand, if the density of the pyrolysed fuel source is too low then the fuel source combusts too actively and thus too rapidly. Balsa and ash have been found to be the more suitable woods for use in this invention, though other wood species may be found to be appropriate.

The smoking material 7 is an aerosol generating means consisting of a high proportion of non-combustible, inorganic material, namely 80% perlite, 12% glycerol aerosol forming means, 7% propylene glycol alginate binder and 1% fibre, i.e. the partially inorganic system. The smoking material is produced by forming a slurry of the components and making a reconstituted sheet in accordance with standard sheet making techniques. The sheet of reconstituted inorganic material is then cut to provide cut filler material 7 and is disposed about the pyrolysed balsa wood fuel source 6.

At the mouth end of the smoking article there is located a region 9 of aerosol generating means onto which has been deposited flavouring agents, such as vanilla and toffee, for example. More of these flavouring agents were disposed within the filter element 3.

In operation, the cigarette 1 is lit and the cigarette burns along the fuel source length producing very little visible sidestream smoke. The visible sidestream smoke produced is derived from the organic components in the smoking article and is most visible at the end of a puff. The substantially non-combustible wrapper chars to produce a frangible, white ash, similar to conventional cigarette ash and which can be tapped off by the smoker, as required. The non-combustible exterior wrapper 5 upon charring also produces a dark burn line which advances along the smoking article as burning progresses. The smoking article burns back along the fuel source 6. As burning occurs an aerosol is produced from the aerosol-generating cut smoking material 7, which aerosol is drawn into the smoker's mouth. The aerosol, in this instance, is predominantly glycerol and water but also comprises vanilla and toffee flavours. Other flavours such as tobacco extracts, nicotine compounds, or other tobacco-like flavours, give the aerosol an acceptable taste and quality but without burning any tobacco material. Additional flavour material is also carried on the filter element, which material is designed to be released upon the approach of 'smoke' or aerosol from the burning aerosol-generating smoking material rod 2, Filter flavourant is not always required if sufficient flavour material is held in the aerosol generating means.

FIG. 1*a* shows a very similar embodiment to FIG. 1 except that in this cigarette, instead of the smoking material rod 2 incorporating cut smoking material 7, the smoking material 7' is present as a rolled sheet 8 of smoking material which is rolled about the longitudinal length of the fuel source 6. The rolled sheet 8 of the smoking material 7' is attached by a line or band of adhesive, such as propylene glycerol alginate, extending along the length of the fuel source 6. The rolled sheet 8 of smoking material must be rolled to allow air to pass to the burning coal of the cigarette 1.

The smoking article 10 depicted in FIG. 2 has a similar structural arrangement to that of FIG. 1. Identical elements of the cigarette 11 have been given the reference numerals of FIG. 1 increased by ten.

In this embodiment the wrapper 15 comprised 1% fibre, 4.5% propylene glycol alginate and 94.5% perlite inorganic, non-combustible filler material. No plasticiser was present in the wrapper.

The fuel source 16 of this embodiment is comprised of combustible material held together with a non-combustible binder. The fuel source 16 comprises carbon in the form of pyrolysed coconut fibre, Portland cement and a small amount of potassium nitrate burn promoter in the ratio of 8:4:1 respectively. The fuel source 16 was produced by hydrating the cement with a 1.3M solution of potassium nitrate sufficient to form a slurry, adding the powdered carbon to the slurry with a small amount of detergent to 'wet' the carbonaceous material, and additional water to provide a slurry of mud-like consistency. A rod of fuel material was formed by shaping the slurry mixture within a hollow tube, the shaped rod being expelled from within the tube once the rod had sufficient mechanical strength after a period of drying, curing or setting. Any excess moisture is driven off by heating after removal from the hollow tube. The fuel source 16 had a diameter of about 4 mm. Surrounded by filler material 17 the fuel source 16 is quite robust and is well able to withstand normal handling in the packing process and by the consumer.

In this embodiment, cocoa flavour was provided at a downstream location of the aerosol generation means 17 and within the filter element 13.

The smoking article 20 depicted in FIG. 3 is a further refinement of the embodiment of FIG. 2. Reference numerals referring to identical elements have again been increased by ten. In this cigarette 21 the smoking material rod 22 comprises cut smoking material 27 disposed about a carbon fuel source 26. The exterior wrapper 25 is composed of two layers. An inner layer 40 is composed of the wrapper material described in FIGS. 1 and 2. An outer layer 41 is comprised of a coating of a visible sidestream reducing filler, such as magnesium oxide bound by a small amount of propylene glycol alginate. The proportions of the wrapper in total were 79.5% perlite, 1% fibre, 4.5% propylene glycol alginate and 15% magnesium oxide. The magnesium oxide coating is capable of further reducing the visible sidestream smoke emanating from the smoking article 10 of FIG. 2, for example. Indeed, the visible sidestream smoke from smoking article 20 is virtually non-existent. However, the exterior wrapper 25 still produces a dark burn line, the advance of which enables the smoker to determine whether the cigarette 21 is, in fact, alight and to thereby monitor the progress of combustion.

In the alternative to a coating of visible sidestream reducing filler, the visible sidestream reducing filler may be included in the wrapper furnish to form a single wrapper. A typical composition of the treated wrapper 25 consists of 87.5% perlite inorganic material, 4% propylene glycol alginate binder, 7.5% magnesium oxide visible sidestream reducing filler and 1% fibre. Levels of 15% magnesium oxide have been used effectively with 80% perlite.

In this embodiment, tobacco extract flavours were disposed within the filter element 23.

The drawing of FIG. 4 shows a further embodiment of the invention in which reference numerals which refer to the same features as in FIG. 3 have been increased by ten. The smoking material rod 32 of cigarette 31 comprised a wrapper 35 enclosing cut smoking material which is also combined with fuel means to provide an aerosol generating fuel source 37. The aerosol generating fuel source 37 together comprises a lengthwise extending fuel source and lengthwise aerosol extending generation means. The aerosol generating fuel source 37 comprises 55% carbon (pyrolysed coconut fibre), 12% glycerol aerosol forming means, 7% propylene glycol alginate binder, 1% fibre and 25% perlite inorganic material, i.e. the partially inorganic system. This material is produced using the reconstituted sheet method described above and casting either on a drum or band caster. At one end of the aerosol generating fuel source 37 there was applied chocolate and mint flavours. Flavour material was also present in the filter element 33.

Examples of another aerosol generating fuel source from the second aerosol generating fuel source system were also produced which comprised as little as 10% carbon and 70% perlite inorganic material. The other proportions remained the same as above.

The wrapper 35 in this embodiment had the composition of 4.5% propylene glycol alginate binder and 94.5% perlite inorganic non-combustible filler material in one instance. In another instance, the wrapper had the composition of 4% propylene glycol alginate, 5% glycerol plasticiser and 90% perlite.

All of the aerosol generating compositions described above may be modified in colour by replacing up to 10% of the inorganic filler material with a colourant, such as caramel or liquorice or extracts thereof.

The percentages given in this specification are on a dry weight basis. The amount of water required to make a suitable slurry of solid components amounting to 500 g (including glycerol) is usually about 1200 ml.

The following tables give further details of embodiments prepared to illustrate the invention.

Table 1 gives details regarding the influence of material formulation on the physical properties of the outer.

A slurry was prepared from hydrated binder and inorganic material to the recipe given in Table 1. Outer wrappers were made from the slurry to a length of 70 mm and 0.5 mm wall thickness by use of a ram extruder. The outer wrappers were dried at exit from the extruder die by use of two intra-red heaters placed 5–10 cm from the extrudate. The physical properties of the outer wrappers are detailed in Table 1.

Table 2 gives details regarding the influence of process conditions on the efficiency of setting outer wrappers using calcium chloride solution.

A slurry was prepared from 10 g sodium alginate, 45 g chalk and 45 g perlite in 200 ml of water. A ram extruder was filled with the slurry and the outer wrappers were prepared by extrusion of the slurry through an 8 mm outer diameter, 7 mm inner diameter torpedo die into calcium chloride solution. Firmness of the outer was judged subjectively by a panel of three individuals, on a ten point scale running from 1 (indicating that the extrudate was completely unchanged by immersion in the bath) to 10 (indicating that the extrudate was completely set and rigid).

The Table illustrates that as the number of uses of the bath is increased, the firmness of the outer wrapper decreases. The firmness of the outer wrapper increases as the concentration of the electrolyte solution increases and as immersion time increases.

Table 3 gives details of the combustion limits of carbon and glycerol based areosol generating fuel sources using a single strand of extruded material of 1.00 mm diameter.

Table 4 shows the effect of binder type on the combustion characteristics of a variety of carbon and glycerol based aerosol generating fuel sources using single strands of extruded material of 1.00 mm diameter. Some binders are more combustible then others and therefore influence the proportions of material used in the aerosol generating fuel source.

Table 5 shows the effect of filler type on the combustion characteristics of a variety of carbon and glycerol based aerosol generating fuel sources using single strands of extruded material of 1.00 mm diameter. Some inorganic filler materials facilitate combustion of a range of aerosol generating fuel source mixtures. Chalk is the preferred filler over the ranges illustrated. This table should not necessarily be taken to indicate that the fillers used in mixtures outside these illustrated ranges would not burn.

The tests performed for Tables 3, 4 and 5 were performed on single strands smouldering in free air rather than on a number of strands within an outer wrapper in order to exclude any influence on the combustion of the strands due to the properties of the outer wrapper.

Table 6 gives smoke yields from filter-tipped cigarettes which had the following construction:

A 5 mm filter was obtained from a State Express International cigarette, the filter comprising fibrous cellulose acetate of 2.8 filament denier of Y cross-section, 34,000 total denier and having a pressure drop of 13 mm WG.

The substantially non-combustible outer wrapper was extruded using a ram extruder through an 8 mm outer diameter, 7 mm inner diameter torpedo die and the aerosol generating fuel source was extruded as 1.00 mm diameter strands from a ram extruder, the strands being gathered together and inserted into dried extruded outer wrappers. The cigarette rod length, i.e. excluding the filter element, was 67 mm. One cigarette of each was smoked under standard machine smoking conditions in which a 35 $cm^3$ puff of two seconds duration is taken every minute.

The first five examples of Table 4 illustrate that carbon fuel strands will burn without producing significant levels of total particulate matter (TPM) even with organic material (PGA) in the fuel strands.

The cigarettes according to the invention have very low visible sidestream smoke levels. However, the nature of the sidestream smoke from the inventive articles does not render the conventional fishtail sidestream measuring apparatus described in Analyst, October 1988, Volume 113, pp 1509–1513 a suitable measuring apparatus. We are thus unable to provide yield details in this respect.

TABLE 1

Influence of Material Formulation on the Physical Properties of the Outer.

| % Perlite | % Chalk | % Binder | Binder Type | % Plasticiser (Glycerol) | Total solids (g) | Water (g) | Permeability (CU) | Energy required to crush outer (J) | Whiteness of outer (DE) |
|---|---|---|---|---|---|---|---|---|---|
| 85 | | 15 | PGA | | 100 | 300 | 94 | | |
| 22.5 | 67.5 | 10 | PGA | | 100 | 200 | 14 | 5.3 | 6.6 |
| | 90 | 10 | PGA | | 100 | 200 | 3.8 | 5.2 | 9.2 |
| 80 | | 20 | PGA | | 100 | 200 | 77 | | 4.6 |
| | 80 | 20 | PGA | | 100 | 200 | 0.6 | | 9.6 |
| | 97.5 | 2.5 | PGA | | 100 | 70 | 6.5 | | 9.2 |
| | 95 | 5 | PGA | | 100 | 40 | 4.5 | | 9.5 |
| 75 | | 25 | PGA | | 100 | 500 | 110.7 | | |
| 75 | | 25 | PGA | | 100 | 260 | | | |
| 90 | | 10 | PGA | | 100 | 200 | | 5.2 | 3.7 |
| 90 | | 10 | HEC | | 100 | 150 | cnm | | |
| 45 | 45 | 10 | HEC | | 100 | 130 | 57 | | |
| 45 | 45 | 10 | AA | | 100 | 120 | 21 | | |
| 90 | | 10 | AA | | 100 | 135 | 160 | | |
| 88 | | 10 | PGA | 2 | 100 | 180 | 185 | | |
| 85 | | 10 | PGA | 5 | 100 | 160 | 145 | | |
| 80 | | 10 | PGA | 10 | 100 | 140 | 215 | | |
| 70 | | 10 | PGA | 20 | 100 | 135 | 105 | | |
| 72 | | 8 | PGA | 20 | 100 | 120 | cnm | | |
| 75 | | 5 | PGA | 20 | 100 | 115 | cnm | | |
| 77.5 | | 2.5 | PGA | 20 | 100 | 110 | | | |
| 90 | | 10 | SCMC | | 100 | | 14 | | |
| 95 | | 5 | SCMC | | 100 | 70 | 17.5 | | 4.4 |
| 97.5 | | 2.5 | SCMC | | 100 | 110 | 34 | | 3.8 |
| 85 | | 15 | SCMC | | 100 | | | | 2.9 |
| 77.5 | 9 | 13.5 | SCMC | | 100 | 100 | 12 | | |
| 85 | 5 | 10 | PGA | | 100 | | 161 | 9.3 | |
| 70 | 20 | 10 | PGA | | 100 | | 120 | 9.2 | |
| 65 | 25 | 10 | PGA | | 100 | | 79 | | |
| 40 | 50 | 10 | PGA | | 100 | | 19.5 | 12 | |
| 45 | 45 | 10 | HPC | | 100 | 95 | 111 | | |
| 90 | | 10 | NaA | | 100 | 160 | 65 | | |
| 45 | 45 | 10 | NaA | | 100 | 120 | 6 | | |
| 90 | | 10 | NaCaA | | 100 | 205 | 70.7 | | |
| 45 | 45 | 10 | NaCaA | | 100 | 190 | | | |
| 90 | | 10 | Karaya gum | | 100 | 175 | 285 | | |
| 45 | 45 | 10 | Karaya gum | | 100 | 130 | cnm | | |
| 90 | | 10 | Locust bean gum | | 100 | 150 | 295 | | |
| 45 | 45 | 10 | Locust bean gum | | 100 | 130 | 60 | | |
| 45 | 45 | 10 | Acacia gum | | 100 | 8 | | | |

PGA Propylene glycol alginate
HEC Hydroxyethyl cellulose
AA ammonium alginate
SCMC Sodium carboxymethylcellulose
NaA Sodium alginate
NaCaA Sodium calcium alginate
DE total colour difference from reference paper
cnm could not measure

TABLE 2

Influence of Process Conditions on the Efficiency of Setting Outer Wrappers using Calcium Chloride solution.

| Calcium chloride solution strength ($M\ 1^{-1}$) | Immersion time in bath (s) | Number of uses of the bath prior to this measurement | Subjective firmness of outer. |
|---|---|---|---|
| 0 | 0 | 0 | 1 |
| 1 | 2 | 0 | 4 |
| 1 | 4 | 0 | 6.5 |
| 1 | 6 | 0 | 7.5 |
| 1 | 8 | 0 | 8 |
| 1 | 10 | 0 | 8 |
| 1 | 60 | 0 | 9.5 |
| 0.1 | 10 | 0 | 2.5 |
| 0.5 | 10 | 0 | 4.7 |
| 1 | 10 | 0 | 6.7 |
| 2 | 10 | 0 | 7.7 |
| 1 | 10 | 1 | 7 |
| 1 | 10 | 2 | 6 |
| 1 | 10 | 3 | 6 |
| 1 | 10 | 4 | 5 |
| 1 | 10 | 5 | 5 |
| 1 | 10 | 6 | 4 |
| 1 | 10 | 7 | 3.6 |
| 1 | 10 | 8 | 3 |

TABLE 3

Combustion Limits of Carbon and Glycerol Based Aerosol Generating Fuel Source (as single strand)

| Fuel Combustions that burn | | | | Fuel Combustions that do not burn | | | |
|---|---|---|---|---|---|---|---|
| % Carbon | % Glycerol | % PGA | % Chalk | % Carbon | % Glycerol | % PGA | % Chalk |
| | | | | 0 | 10 | 10 | 80 |
| | | | | 4 | 10 | 10 | 76 |
| 5 | 20 | 10 | 65 | 5 | 20 | 10 | 65 |
| 7 | 20 | 10 | 63 | | | | |
| 8 | 26 | 10 | 56 | 8 | 5 | 10 | 77 |
| 8 | 30 | 10 | 52 | 8 | 10 | 10 | 72 |
| | | | | 8 | 15 | 10 | 67 |
| | | | | 8 | 21.5 | 10 | 60.5 |
| 9 | 15 | 10 | 66 | | | | |
| 9 | 20 | 10 | 61 | | | | |
| 10 | 15.5 | 10 | 64.5 | 10 | 0 | 10 | 80 |
| | | | | 10 | 10 | 10 | 70 |
| 11 | 15 | 10 | 64 | 11 | 3 | 10 | 76 |
| 11 | 20 | 10 | 59 | 11 | 11 | 10 | 68 |
| 11 | 21 | 10 | 58 | | | | |
| 11 | 30 | 10 | 49 | | | | |
| 12 | 8 | 10 | 70 | 12 | 0 | 10 | 78 |
| 12 | 9 | 10 | 69 | 12 | 6 | 10 | 72 |
| 12 | 10 | 10 | 68 | 12 | 7 | 10 | 71 |

TABLE 3-continued

Combustion Limits of Carbon and Glycerol Based Aerosol Generating Fuel Source (as single strand)

| Fuel Combustions that burn | | | | Fuel Combustions that do not burn | | | |
|---|---|---|---|---|---|---|---|
| % Carbon | % Glycerol | % PGA | % Chalk | % Carbon | % Glycerol | % PGA | % Chalk |
| 12 | 11 | 10 | 67 | | | | |
| 13 | 20 | 10 | 57 | | | | |
| 15 | 6 | 10 | 69 | 15 | 0 | 10 | 75 |
| 15 | 20 | 10 | 55 | 15 | 3 | 10 | 72 |
| 20 | 6 | 10 | 64 | 20 | 0 | 10 | 70 |
| 20 | 10 | 10 | 60 | 20 | 3 | 10 | 67 |
| 30 | 0 | 10 | 60 | | | | |
| 30 | 3 | 10 | 57 | | | | |
| 30 | 6 | 10 | 54 | | | | |
| 50 | 0 | 10 | 40 | | | | |

TABLE 4

Influence of binder type on the combustion characteristics of various aerosol generating fuel source mixtures.

| | Binder Type | | | | |
|---|---|---|---|---|---|
| | Propylene Glycol Alginate | Sodium Alginate | Calcium Alginate | Pectin | Hydroxy Propyl Cellulose |
| 8% Carbon<br>11% Glycerol<br>71% Chalk<br>10% Binder | No | Yes | No | No | Yes |
| 12% Carbon<br>11% Glycerol<br>67% Chalk<br>10% Binder | Yes | Yes | No | Yes | Yes |
| 16% Carbon<br>11% Glycerol<br>63% Chalk<br>10% Binder | Yes | Yes | No | Yes | No |
| 8% Carbon<br>11% Glycerol<br>61% Chalk<br>20% Binder | Yes | Yes | No | Yes | Yes |
| 12% Carbon<br>11% Glycerol<br>57% Chalk<br>20% Binder | Yes | Yes | No | Yes | Yes |
| 16% Carbon<br>11% Glycerol<br>53% Chalk<br>20% Binder | Yes | Yes | No | Yes | Yes |
| 8% Carbon<br>11% Glycerol<br>51% Chalk<br>30% Binder | Yes | No | No | Yes | — |
| 12% Carbon<br>11% Glycerol<br>47% Chalk<br>30% Binder | Yes | No | No | Yes | — |
| 16% Carbon<br>11% Glycerol<br>43% Chalk<br>30% Binder | Yes | No | No | Yes | — |

TABLE 5

Influence of inorganic filler type on the combustion characteristics of various aerosol generating fuel source mixtures.

| | Filler Type | | | | | | |
|---|---|---|---|---|---|---|---|
| Fuel Mixture | Perlite | Magnesium Oxide | Bentonite | Chalk | Calcium Sulphate | Magnesium hydroxide | Kieselguhr |
| 18.2% Carbon, 11.4% PGA, 12.5% Glycerol, 58% Filler | No | No | No | Yes | No | No | Yes |
| 16.3% Carbon, 10.2% PGA, 11.2% Glycerol, 62.2% Filler | No | No | No | Yes | No | No | Yes |
| 15.8% Carbon, 13.2% PGA, 14.5% Glycerol, 56.5% Filler | No | No | No | Yes | No | No | — |
| 14.8% Carbon, 9.3% PGA, 10.2% Glycerol, 65.7% Filler | No | — | No | Yes | No | No | No |
| 13.9% Carbon, 11.6% PGA, 12.8% Glycerol, 61.6% Filler | No | — | No | Yes | No | No | No |
| 12.5% Carbon, 10.4% PGA, 11.5% Glycerol, 65.6% Filler | — | No | — | Yes | No | No | No |
| 10.5% Carbon, 13.2% PGA, 14.5% Glycerol, 61.8% Filler | No | No | No | Yes | — | No | No |
| 9.3% Carbon, 11.6% PGA, 12.8% Glycerol, 66.3% Filler | — | No | No | No | — | No | No |
| 8.3% Carbon, 10.4% PGA, 11.5% Glycerol, 69.8% Filler | No | — | — | No | — | No | No |

— mixture not produced

TABLE 6

Smoke yields from filter tipped cigarettes illustrating the invention

| Weight (g) | % Perlite | % Sodium Alginate | Weight (g) | % Carbon | % Glycerol | % Chalk | % PGA Binder | Puff number | TPM (mg) | Glycerol (mg) |
|---|---|---|---|---|---|---|---|---|---|---|
| 0.6035 | 90 | 10 | 0.5865 | 12 | 0 | 78 | 10 | DNB | 0.0 | 0 |
| 0.4025 | 90 | 10 | 0.7255 | 15 | 0 | 75 | 10 | 5 | 0.0 | 0 |
| 0.4535 | 90 | 10 | 0.7291 | 20 | 0 | 70 | 10 | 10 | 0.2 | 0 |
| 0.4774 | 90 | 10 | 0.6896 | 30 | 0 | 60 | 10 | 6 | 0.0 | 0 |
| 0.3812 | 90 | 10 | 0.5973 | 50 | 0 | 40 | 10 | 5 | 0.1 | 0 |
| 0.6001 | 90 | 10 | 0.6847 | 8 | 5 | 77 | 10 | DNB | 0.0 | 0 |
| 0.6344 | 90 | 10 | 0.7186 | 12 | 6 | 72 | 10 | 7 | 4.3 | 2 |
| 0.6555 | 90 | 10 | 0.7691 | 15 | 6 | 69 | 10 | 7 | 3.3 | 1 |
| 0.6777 | 90 | 10 | 0.6818 | 20 | 6 | 64 | 10 | 8 | 3.0 | <1 |
| 0.4730 | 90 | 10 | 0.7691 | 30 | 6 | 54 | 10 | 6 | 2.2 | <1 |
| 0.6312 | 90 | 10 | 0.6530 | 40 | 6 | 44 | 10 | 8 | 1.9 | <1 |
| 0.5103 | 90 | 10 | 0.4808 | 12 | 8 | 70 | 10 | 9 | 1.3 | <1 |
| 0.5845 | 90 | 10 | 0.6990 | 4 | 10 | 76 | 10 | DNB | 0 | 0 |
| 0.6219 | 90 | 10 | 0.7192 | 8 | 10 | 72 | 10 | 6 | 3.8 | 2 |
| 0.5060 | 90 | 10 | 0.6780 | 10 | 10 | 70 | 10 | DNB | 0 | 0 |
| 0.4872 | 90 | 10 | 0.6916 | 11 | 10 | 69 | 10 | 5 | 4.3 | 3 |
| 0.6035 | 90 | 10 | 0.5865 | 12 | 10 | 68 | 10 | DNB | 0 | 0 |
| 0.5665 | 90 | 10 | 0.6215 | 9 | 15 | 66 | 10 | 8 | 5.7 | 2 |
| 0.4838 | 90 | 10 | 0.7133 | 10 | 15.5 | 64.5 | 10 | 7 | 5.4 | 3 |
| 0.5161 | 90 | 10 | 0.7092 | 11 | 15 | 64 | 10 | 6 | 7.5 | 3 |
| 0.6103 | 90 | 10 | 0.6443 | 8 | 21.5 | 60.5 | 10 | 6 | 6.4 | 3 |
| 0.4461 | 90 | 10 | 0.7446 | 8 | 26 | 56 | 10 | 6 | 12.7 | 6 |

What is claimed is:

1. A smoking article comprising a substantially non-combustible smoking article wrapper enwrapping a smoking material rod, said wrapper being comprised of predominantly non-combustible, particulate, inorganic filler material, a binder, optionally a plasticiser, wherein the wrapper is free of cellulosic fibre material, said inorganic filler material being at least 65% by weight of said wrapper and the binder is an organic binder selected from one or more of the group consisting of cellulose derivatives, cellulose ethers, alginic binders, gums, gels, pectins and starches.

2. A smoking article according to claim 1, wherein said non-combustible inorganic filler material is a non-metallic material.

3. A smoking article according to claim 1, wherein said non-combustible inorganic filler material is one or more selected from the group consisting of perlite, vermiculite, diatomaceous earth, colloidal silica, chalk, magnesium oxide, magnesium sulphate, magnesium carbonate and other low density, non-combustible inorganic filler materials.

4. A smoking article according to claim 3, wherein the inorganic filler material comprises at least 80% by weight of the wrapper.

5. A smoking article according to claim 4, wherein the inorganic filler material comprises at least 90% by weight of the wrapper.

6. A smoking article according to claim 1, wherein the inorganic filler material comprises at least 70% by weight of the wrapper.

7. A smoking article according to claim 1 wherein the wrapper comprises up to 30% by weight of the wrapper of at least one selected from the group consisting of a binder and a plasticizer.

8. A smoking article according to claim 7 wherein the binder is present at about 8–10% by weight of the wrapper.

9. A smoking article according to claim 7 wherein the binder is present at about 8–10% by weight of the wrapper.

10. A smoking article according to claim 7 wherein the binder is present at about 5% or less by weight of the wrapper.

11. A smoking article according to claim 7, wherein the plasticiser is present at up to 20% by weight of the wrapper.

12. A smoking article according to claim 11, wherein the plasticiser is present in about 10% or less by weight of the wrapper.

13. A smoking article according to claim 12, wherein the plasticiser is present at about 5% or less by weight of the wrapper.

14. A smoking article according to claim 7 wherein the plasticizer is one or more selected from the group consisting of glycerol, propylene glycol, low melting point fats and low melting point oils.

15. A smoking article according to claim 1 wherein the organic binder is one or more of sodium carboxymethyl cellulose, methyl cellulose, hydroxypropyl cellulose, hydroxyethyl cellulose, ammonium alginate, sodium alginate, potassium alginate, magnesium alginate, triethanol-amine alginate, propylene glycol alginate, aluminum alginate, copper alginate, zinc alginate, silver alginate, gum arabic, gum ghatti, gum tragacanth, Karaya gum, locust bean gum, acacia gum, guar gum, quince see gum, xanthan gum, agar, agarose, caragenneans, fucoidan or furecelleran.

16. A smoking article according to claim 1 wherein the permeability of said wrapper is within the range of 1–150 Coresta Units.

17. A smoking article according to claim 1 wherein the wrapper comprises a deodorizer selected from the group consisting of citronellal, geraniol and vanillin.

* * * * *